United States Patent [19]

Cardinal et al.

[11] 3,987,614

[45] *Oct. 26, 1976

[54] VOLUMINOUS FILAMENT YARN

[75] Inventors: Jutta Cardinal, Hofheim, Taunus; Karl Heinrich; Günther Bauer, both of Bobingen, all of Germany

[73] Assignee: Hoechst Aktiengesellschaft, Frankfurt am Main, Germany

[ * ] Notice: The portion of the term of this patent subsequent to Dec. 24, 1991, has been disclaimed.

[22] Filed: Aug. 6, 1974

[21] Appl. No.: 495,192

Related U.S. Application Data

[63] Continuation-in-part of Ser. No. 378,018, July 10, 1973, Pat. No. 3,857,233.

[30] Foreign Application Priority Data

Feb. 19, 1973 Germany ..... 2308031

[52] U.S. Cl. ..... 57/140 BY; 57/140 R

[51] Int. Cl.[2] ..... D02G 3/04; D02G 3/34

[58] Field of Search ..... 57/2, 140 BY, 140 R, 57/140 J, 157 R, 157 TS, 157 F, 157 S

[56] References Cited

UNITED STATES PATENTS

| | | | |
|---|---|---|---|
| 3,001,358 | 9/1961 | Mayner | 57/2 X |
| 3,043,088 | 7/1962 | Breen | 57/157 F |
| 3,137,991 | 6/1964 | Fairley | 57/140 BY |
| 3,214,899 | 11/1965 | Wininger, Jr. et al. | 57/157 F X |
| 3,242,035 | 3/1966 | White | 57/140 R |
| 3,708,970 | 1/1973 | MacFarlane | 57/157 TS X |
| 3,733,801 | 5/1973 | Jones | 57/157 TS |
| 3,831,360 | 8/1974 | Howath | 57/2 |
| 3,877,213 | 4/1975 | MacFarlane | 57/157 TS X |

*Primary Examiner*—Richard C. Queisser
*Assistant Examiner*—Charles Gorenstein
*Attorney, Agent, or Firm*—Connolly and Hutz

[57] ABSTRACT

Object of the invention is a voluminous filament yarn of three-dimensionally curled filaments without loops, coils or whorls having a positive value of residual crimp $c_3$, with several loose filament ends sticking out and at least said ends having a flex abrasion resistance of less than about 1500 cycles. The obtained yarn excels in the uniformity of its characteristics all over the yarn length, its high crimp elongation and recovery from stretch and can be worked up to fabrics having an extremely low tendency to pilling.

5 Claims, No Drawings

VOLUMINOUS FILAMENT YARN

The present application is a continuation-in-part application of application Ser. No. 378,018 filed July 10, 1973, now U.S. Pat. No. 3,857,233, issued Dec. 31, 1974.

The normal result of a production of synthetic high-polymer threads consists in smooth filament threads; when being submitted to further treatment, same produce correspondingly smooth textile surfaces lacking the usual soft hand and the covering power of surfaces formed by spun fiber yarns. Attempts to ameliorate these characteristics by texturizing the filament threads were not entirely successful. Obviously, the loose ends of individual fibers play an important role for specifically evaluating the textile surfaces of spun fiber yarns fabrics.

The preparation of spun fiber yarns requires many processing steps which imply intense wage costs. Therefore, processing methods have already been developed which are supposed to allow the preparation of filament yarns with loose filament ends out of ordinary filament yarns, while avoiding nevertheless the cutting of synthetic continuous threads (filaments) to staple fibers and their subsequent secondary spinning.

German Offenlegungsschrift 1 660 606 describes a process for preparing such fluffy yarns, which mechanically rips and unravels the surface of a drawn filament yarn by rotating brushes. But this process is limited to foamed thermoplastic polymers and, obviously, it is applicable to coarse yarns only.

According to British Patent 924 086 it is said to be possible to jointly draw filaments of different elongation in such a way that one of the components breaks and thus results in the loose ends looked for.

British Patent 971 573 claims a similar process, wherein two yarns of different elongation at break are jointly submitted to a simultaneous stretching and texturizing treatment, and whereby the drawing proportion must be set in such a manner that the breaking filaments are those of the yarn having the lower elongation at break. Though this process results in a fluffy yarn with several loose filament ends sticking out, it is, however, still ridden by a series of disadvantages. Since the effect looked for can be attained only by elongation, a portion of the filaments up to their breaking point, the yarn tension within the texturizing area cannot be chosen according to the optimal crimping properties. The yarn tension is predetermined already by the requirement of breaking one of the components.

When practicing a simultaneous drawing and texturizing process, the elongation occurs at the beginning of the heater device of the used false twist texturizing apparatus. Due to the fact that this known process causes a portion of the filaments to break within the drawing zone, the loose ends jam the twister of the texturizing device again and again. Besides these processing difficulties, the treatment includes still further disadvantages according to the statements of British Patent 971 573: A filament does not break before being overstretched to an accordingly high extent, the area immediately adjacent to the break, however is not picked up right away by the pre-stretch godet, so that it remains unstretched or, at most, only partially stretched over a certain length. As a matter of fact, an irregular adsorption of dyestuff is the unavoidable consequence of an irregular stretching treatment, so that the woven or knitted fabrics made of these yarns show an uneven coloration. Furthermore, the filament yarns with several loose filament ends prepared as per British Patent 971 573 show a strong tendency to pilling, such as it is known from spun fiber yarns made of synthetic highpolymers.

Therefore, it is the object of the present invention to develop an operationally safe process for preparing voluminous filament yarns with several loose filament ends sticking out, whereby the filaments of the yarns display uniform characteristics all over their length and whereby the crimping properties may be freely set depending on the application field of the yarn. The thus prepared fluffy yarns should also be usable for the formation of fabrics excelling in their extremely low tendency to pilling.

This problem could be solved by the application of a false twist texturation treatment, optionally combined with a drawing process, dealing with filament yarns where at least a portion of the used filaments have a flex abrasion resistance of less than about 1500 cycles; The filament yarns to be treated are fed into known false twist texturizing apparatus and texturized, whereby the filaments having the lower flex abrasion resistance are breaking in irregular intervals due to the transversal sress applied within the texturizing zone; the loose filament ends of the thus obtained filament yarns are then interlaced, at least temporarily, by a processing step for amelioration of the filament bonding.

FIG. 1 shows the pilling curves of three different woven fabrics according to Example 2 as functions of testing time in a Random Tumble Pilling Tester.

FIG. 2 illustrates the fundamental structure of the filament yarns according to the invention.

For the preparation of the fluffy yarns according to the invention all continuous filaments may be used that consist, at least partially, of filaments either having initially a sufficiently low flex abrasion resistance of less than 1500 cycles, or the flex abrasion resistance of which may be brought down to this level by known methods. Best suited are filaments which have a flex abrasion resistance of less than about 1000 cycles and especially those of less than 500 cycles. The value of the flex abrasion resistance influences the number of the loose filament ends sticking out which are produced in course of the process as per the invention, whereby the filament having the lower flex abrasion resistance does break easier while being exposed to the transversal stress of the texturizing area. However, the number of the loose filament ends may also be influenced by setting the portion of filaments with a lower flex abrasion resistance used in the total filament yarn. Depending on a reduction of the flex abrasion resistance, the tendency to pilling of the woven and knitted fabrics is also decreasing substantially; however, as the term "flex abrasion" already implies, it is not normally possible to produce or to use practically useful filament yarns having a flex abrasion resistance of e.g. Zero. But it is possible to use filaments having a flex abrasion resistance of e.g. as little as 5 cycles in cases, where especially strict requirements are set up concerning the lack of tendency to pilling of certain woven or knitted fabrics.

Measuring of the flex abrasion resistance is executed by means of the flex abrasion device as described, for instance, by Grunewald in "Chemiefasern 12 (1962), pg. 853". Filaments having a reduced flex abrasion resistance, but a good linear strength (in the longitudinal sense of the fiber) may, for instance, be obtained from synthetic highpolymers by using polymerizates with a sufficiently low molecular weight; as examples may be cited here the products according to Deutsche Auslegeschrift 1278688. In the case of threads made of polyethylene-terephthalate, for instance, the following proportions between flex abrasion resistance and average molecular weight could be found: A flex abrasion resistance of 1500 cycles is linked to an average molecular weight about 12 500, whilst flex abrasion resistance values of less than 10 cycles may be linked to average molecular weights of about 8000. Polyethylene-terephthalate threads having so low a molecular weight cannot be melt-spun any longer at an economically reasonable rate due to the low melt viscosity of the polymers, but they may be prepared by polymers according to German Auslegeschrift 1237 727, Deutsche Auslegeschrift 1273 123 or Deutsche Auslegeschrift 1720 647.

Threads of linear polymers which may partially be treated in a permanently cross-linked fashion can as well have a reduced flex abrasion resistance. Therefore, same are also well suitable for being processed according to the invention, within the said range of flex abrasion resistance values.

Depending on the application, all of the filaments of the filament yarn may have the lower flex abrasion resistance of less than 1500 cycles looked for, so that they may yield filament ends — or only a portion of the filaments does possess these properties, while the rest shows a high flex abrasion resistance so that it does not break while being exposed to the transversal stress in the texturization area. In the first case, the filaments have to be interlaced slightly tighter for attaining a sufficient strength of the yarn, whilst in the latter case the continuous filaments guarantee anyway a sufficient strength of the yarn. Filament yarns composed — in the proportion of 7:3 to 3:7 — of filaments having a lower flex abrasion resistance (less than 1500 cycles) blended with filaments having a flex abrasion resistance of 1500 and higher (e.g. 3000 cycles), formed woven and knitted fabrics which excelled in a particularly attractive appearance and remarkable wear. It is also possible to choose freely — depending on the specific application field — the titer and the profile of the filaments, as well as the number of the filaments, which means the total titer of the filament yarn. In most of the cases the titer will remain within the range of from 1 to 15 dtex per filament and below 300 dtex for the yarn, as it is usual for textile application purposes, but it may as well be set at a higher level for special purposes such as decorative fabrics. The upper limit is, at most, given by the texturization process. In case that different filaments are worked up into one yarn, their titers and cross sections may differ as well, of course. In case that the filaments are also made of different raw materials, their various characteristics may well be utilized for further effects, such as different shrinkage or bicomponent-threads may result in additional bulk effects, different adsorption of dyestuffs may lead to mixture yarn or coloured twist yarn effects or the use of flame-proof or flame-retarding yarn components may produce filament yarns of ameliorated flame resistance. On the other hand, it is also possible to modify the dyeing qualities of the filaments in an appropriate manner so that uniform coloration may take place. Since the process according to the invention draws the filaments evenly before breaking them, a uniform coloration all over their length — including the loose filament ends — is guaranteed, in contradiction to the known processing methods which provoke the breaking of the filaments by over stretching same in the stretching area.

A preferred embodiment of the invention are voluminous filament yarns of component blends, which show different individual titers and the loose filament ends of which are formed by the yarn component having the lowest individual titer.

Generally, it is useful to blend the individual components when processing filaments into one filament yarn. This blending may take place, depending on the specific conditions, in anyone of the different processing stages. For example, both of the two kinds of filaments may be spun by means of one same spinning nozzle, or of two adjacent spinning nozzles, such as described by British Patent 1208 801. But it is also possible to ply the various types of filaments while passing the stretching area. A better blending may, in any case, be encouraged by interlacing or applying an electrostatic charge.

When choosing the false twist texturization according to the process of the invention, the usually preferred devices are false twist spindles, since the turning around on the spindle favors even better the formation of filament ends than the torsion stress alone occuring during the frictional texturization. The number of the loose filament ends is also influenced, for instance, by the texturization parameters temperature, yarn tension upstream and downstream the spindle, coating product, number of spindle revolutions, travel speed of the yarn as well as by the shape and surface characteristics of the spindle.

Breaking of the filaments with reduced flex abrasion resistance takes place in irregular intervals under application of the usual texturization parameters, but the result is an even and not periodical distribution of the loose filament ends all over the total length of the filament yarn. In contradiction to the afore said, the hitherto known processing methods for the preparation of fluffy yarns, which induce the filaments to break by overstretching while being drawn, easily causes a plurality of filament ends to break simultaneously and thus leads — at least — to an irregular accumulation of the loose filament ends sticking out. All the filament yarns that may be submitted to a false twist process while being texturized are suitable for use in the process according to the invention. These yarns may be composed, e.g., of high molecular polyamides, polyesters, polyolefins, polyacryl-nitriles, celluloses or thread-forming copolymers or derivatives of these materials.

A preferred embodiment of the invention for producing filament yarns consisting of polyester filaments is the simultaneously executed drawing and texturizing process of undrawn spinning materials (threads), whereby especially the use of undrawn, pre-orientated polyester filaments according to the U.S. patent application Ser. No. 338,312 may give optimal texturization results.

The drawing proportion, that is the proportion of the initial speed to the final speed of the yarns in the false twist texturization apparatus has to be chosen so as to draw all the filaments completely. When different filaments are utilized, efforts have to be made by the choice of different pre-orientations to adapt, as far as possible, the drawing proportions of all filaments to each other. This is the only possibility that guarantees the all-over uniform drawing of all the filaments over their total length, and thus to guarantee an even adsorption of dyestuff.

The process according to the invention does not insist in imparting to the fed-in spinning yarns a flex abrasion resistance of less than e.g. 1500 cycles already before the combined drawing and texturization, in case that undrawn or partially drawn filament yarns are utilized. However, the reduction — according to the invention — of the flex abrasion resistance of at least one titer of the filaments cannot be dispensed with at the moment of the yarn reaching the twister of the used false twist device. After being texturized the broken filament ends are partially still sticking out far of the filament yarn, so that they have to be interlaced at least temporarily before being submitted to further treatment. For this purpose are suitable all known process methods for amelioration of the filament bonding such as treatment by sizing or twisting of the yarn. But in general the application of a twist onto the fluffy filament yarn is not so much preferred, since this high-cost implying processing step is responsible for a loss of volume of the filament yarns. A preferred method for ameliorating the filament bonding is to interlace the threads immediately after their having left the false twist texturization. The interlacing by gas-blasting replaces generally more and more the twist process when preparing synthetic threads, since this gas-blasting may take place at high turnover speeds and continuously following other processing stages. U.S. Pat. No. 2,985,995 e.g. describes interlacing devices. The open structure of the voluminous filament yarns may well be entirely preserved, if interlacing of the filament ends may be produced by application of a size which can be washed out again after weaving or knitting.

The voluminous filament yarns according to the invention exhibit — dependent on the applied false twist texturization — a high degree of crimp elongation and crimp recovery. The filaments of the yarn show a three-dimensional curled crimp without formation of loops, coils, or whorls. The extent of the crimp elongation can be altered or set by applying a second heat treatment at controlled yarn tension as known in the art. Voluminous filament yarns according to the invention are preferred showing an initial crimp $c_1$ of more than 5 percent and especially more than 10 percent. The corresponding values of the residual crimp $c_3$ positive and often of more than 4 percent and preferred more than 10 percent (for the definition of these crimp characteristics see e.g. J. W. Luenenschloss, "Prüfverfahren für texturierte Fäden", Melliand Textilberichte 7/1971, page 760).

In contrast to the looped yarns as mentioned e.g. in U.S. Pat. No. 2,869,967 the yarns according to the invention display an incomparably higher volume and better handle and in particular much better crimp characteristics. For instance, the looped yarns show a crimp elongation (measured as initial crimp $c_1$) of less than 2 percent and a recovery of crimp (measured as residual crimp $c_3$) often less than zero.

On the other hand, the yarns according to the invention are able to recover after an applied stress, e.g. woven fabrics do not loose their shape after applying a load, because there is not any loop or coil, which can be drawn off irreversibly.

The voluminous filament yarns with loose filament ends sticking out according to the process of the invention show their superiority in course of their further treatment especially by the high degree of levelness of all their textile technological properties all over the length of the yarn. These yarns display a distinctly higher volume — compared to the usual texturized filament yarns — having also a considerably higher covering power. Therefore, it is possible to produce the same individual impression of a specific material already at a noticeably reduced weight per square meter. However, the most remarkable quality of the fabrics formed by the filament yarns of the invention is their extremely low tendency to pilling.

The known high tendency to pilling of spun fiber yarns made of synthetic fibers could be checked and brought down to an acceptable level by developing so-called "low-pilling" types of fibers (cf. to this subject e.g. "P. Braun, Chemiefasern/Textilindustrie 1972, pg. 537 to 540"). It was found, surprisingly, that the yarns according to the invention — despite their great volume and the general lack of yarn torsion — could be worked up to fabrics, the tendency to pilling of which did not even reach that of the most pill-lacking spun fiber yarns known to the art.

The tendency to pilling of surfaces was tested by the Random Tumble Pilling Tester (cf. e.g. Baird, Legere, Standley in "Textile Research Journal" 26 (1956), page 731, and ASTM Standards on textile materials 1961, pg. 552). The tendency to pilling was evaluated visually by application of "Reutlinger Pillgrade" (synopsis cf. e.g. Grunewald in Chemiefaser (12) 1968, pg. 936).

The flex abrasion resistance was determined, as said before, by means of a flex abrasion device, whereby the filaments to be examined are loaded with 0.45 g/dtex, the diameter of the wire being 0,02 mm up to 6,7 dtex, 0,04 mm up to 13 dtex and 0,05 mm for even higher titers, flexing takes place at an angle of 100° at a speed of 126 cycles/min.

In order to characterize the bulk of the filament yarns, the following crimping characteristics have been selected:

$$\text{initial crimp } C_1 = \frac{X_2 - X_1}{X_2} \cdot 100\ (\%)$$

$$\text{residual crimp } C_3 = \frac{X_2 - X_4}{X_2} \cdot 100\ (\%).$$

The values $X_1$ to $X_4$ necessary for the calculation of the respective data can be obtained by the following test: The yarns to be tested are wound up under a tension of 0.04 to 0.06 g/dtex to a rope of 11,100 dtex, which rope is loaded with a pre-load of 10 g for 11,100 dtex each. While maintaining the pre-load, the rope is treated for 5 minutes with hot air of 130°C and its length is measured after cooling ($X_1$).

The value $X_2$ is obtained after having loaded the rope for 30 seconds with the main load of 1000 g for 11,100 dtex each, while $X_4$ is obtained after a permanent load of 7 kg for 11,100 dtex each for 30 seconds with subsequent recovery for 5 minutes under the preliminary load.

The following examples illustrate the invention:

EXAMPLE 1

According to the process of the invention a fluffy yarn as blended yarn has been produced, made up of 12 continuous filaments having the titer dtex 5,5 ("yarn component dtex 67 f 12") and of 40 filaments having the titer dtex 1,7 ("yarn component dtex 67 f 40") with loose filament ends sticking out.

The yarn component 67 f 12 consisted of a polyethylene-terephthalate of the relative viscosity $\eta_{rel}$=1,81 (measured at a solution of 1 g in 100 ml of a mixture of phenol-tetrachloroethane, weight proportion 3:2 at 25° C). The polymer material for the yarn component 67 f 40 was prepared similar to example 1 of German Auslegeschrift 1 720 647, whereby the 2,4 g of zinc acetate were replaced by 3,1 g of manganese acetate and whereby the quantity of the trimethoxysilanethanephosphonic acid-diethylester was increased from 48 g to 72 g.

The two polymer materials were spun in one spinning nozzle according to U.S. Pat. No. 2,398,729 at a temperature of 290° C and the spinning threads fed in and taken up at a speed of 1400 m/min. The relative viscosity of the spinning threads amounted to 1,80 or 1,56. The elongation at break of the filaments amounted to 310 % for the coarse titers and 375 % for the fine-titer filaments — at room temperature, the double refractions of the filaments amounted to 9,3 or $6{,}6 \cdot 10^{-3}$.

The blended yarn obtained was submitted to a simultaneous draw-texturization in a false twist texturizing apparatus with false twist spindle having a sapphire center pin. The feed-in speed was 57 m/min, the output speed was 166 m/min corresponding to a stretch-proportion of 1:2,90. The yarn was first directed in the texturization device over a contact heater 1 m long, having a surfacial temperature of 190° C, the distance between the contact heater and the spindle was 15 cm.

A false twist was imparted to the filament yarn of 2700 revol/m. The filament yarn was interlaced in a gas jet after having left the texturizing device, and then rolled up.

The obtained voluminous filament yarn showed an average of 2 loose filament ends per cm of yarn length. This fact allows to estimate an average "staple length" of abt. 40 cm, considering the 40 individual filaments of the yarn component 67 f 40. The broken filament ends showed a flex abrasion resistance of 350 cycles, whilst the filaments of the other yarn component (67 f 12) showed a flex abrasion resistance of 3630 cycles (in each case is given the average out of 25 measurings).

The obtained voluminous filament yarn had a tendency of 21 g/tex and an elongation to rupture of 22%. This yarn did not show any loops, coils or whorls.

The following crimp characteristics have been measured:

| | |
|---|---|
| initial crimp | $C_1$ = 15% |
| residual crimp | $C_3$ = 10% |

EXAMPLE 2

A filament yarn of the total titer of dtex 135 f 52 according to example 1 had been worked up to a fabric with linen weave in warp and weft, the weight per sq. m was 106 g. The fabric was finished as usual, i.e. washed, dried, dyed (90 minutes at 125° C) and set (156° C) and then submitted in this condition to a pilling test by the Random Tumble Pilling Tester. FIG. 1, line A represents the values measured.

For comparison's sake fabrics have been used made of fiber yarn, in one case a material made of a low-pilling polyester type, whereby the used polymer material was that of example 1 (of the yarn component 67 f 40). The fiber yarn with $N_m$70/1 and a twist of 980 rev/m was composed of spun fibers having the individual titer dtex 1,7/40 mm, the flex abrasion resistance was that of the yarn component 67 f 40 of example 1. This fiber yarn was worked up in the same manner to a fabric of linen weave having the same weight per sq. m and being finished identically. The obtained pilling line was shown with "B" in FIG. 1.

A further comparison was made on the basis of a fiber yarn made of normal polyester as per the yarn component 67 f 12 of example 1. The material showed approximately the same flex abrasion resistance of abt. 3 800 cycles, was — however — corresponding exactly to the afore-described spun fiber yarn of the low-pilling type. Similar fabrics were also made of this material and their pilling properties tested (line "C" in FIG. 1).

As the lines of FIG. 1 demonstrate, comparative test C under the chosen test conditions (fiber yarn made of normal polyethylene-terephthalate) shows a strong tendency to pilling, which climbs fast to value 7 (heavily pilled, shaped of the pill mostly ripe) during the test and then remains on this level. Contradictory to these results, a fabric made of a low-pilling polyethylene-terephthalate fiber yarn shows — after having passed an initial maximum — stable values of the test grade 1, i.e. only roughened, fluffy, fibrous (line B). Fabrics made of the voluminous filament yarn according to the invention having individual filament ends, at the beginning of the pilling test also shows first a climbing line, but already one hour of test time later it dropped back to zero, that means that the test fabric did not show any modifications later on.

Double-sided circular knit goods (lap Rodier) having a weight p/sq.m of about 173 g/sq.m each have also been produced of the filament yarns of example 1 as well as of the fiber yarn specified above, and submitted to corresponding pilling tests. The pilling curves obtained for these knit goods were exactly of the same direction as the line of FIG. 1.

The fabrics produced of the voluminous filament yarns according to the invention showed remarkable differences concerning covering power, volume and purity of the appearance compared to those made of fiber yarns, at the same weight per square meter. All the criterions could be much better evaluated via the fabrics formed by voluminous filament yarns according to the invention.

EXAMPLE 3

The undrawn blended filament yarn according to example 1 was submitted to a so-called sequence texturization process. The drawing of the yarn occurs between two feed-in devices at speeds of 48 and 166 m/min. over a pin heated to 90° C. The yarn, immediately after the drawing process still entirely free of loose or broken ends, was then directly fed into a continuously working false twist apparatus, the same embodiment as specified in expl. 1. The yarn was charged with a false twist of 2700 rev/m after having left the texturization device the yarn is treated with a sizing product of acrylic acid ethylester, acrylic acid amide and acrylic acid sodium salt for amelioration of the filament bonding. The size coating amounted to about 10 wt%. The obtained voluminous filament yarn having several loose filament ends sticking out showed about 2 filament ends per cm of yarn length, the tenacity of the yarn was 19 g/tex at an elongation of 14%.

The yarn so obtained was free of coils, loops and whorls.

It showed the following crimp characteristics:

| | |
|---|---|
| Initial crimp | $C_1 = 34\%$ |
| residual crimp | $C_3 = 24\%$. |

EXAMPLE 4

According to a further operational variation of the invention the filament yarn had been produced in such a way, that the two blended yarn components were spun separately, plyed in a draw-twister and then texturized. The spun material was polyethylene-terephthalate, as described in example 1, at a temperature of 290° C. The yarn component for producing dtex 67 f 12 was rolled up at a melt output of 35.5 g/min at a speed of 2 400 m/min, whilst the yarn component for dtex 67 f 40 was rolled up at a melt output of 32.5 g/min at a speed of 2 200 m/min.

The two spinning bobbins were fed into a known draw-twister and jointly drawn at a drawing proportion of 1:2,2 over a heated pin, a surfacial temperature of 100° C and an adjacent heater plate having a temperture of 165° C. The two yarn components were plyed on the draw-twister, the obtained blended yarn showed a twist of 20 rev./m, loose ends of individual filaments could not be observed.

A separate measuring of the textile values showed for dtex 67 f 12 a strength of 36,5 g/tex at an elongation of 27% and a flex abrasion resistance of 3800 cycles, whilst the yarn component 67 f 40 had a strength of 27 g/tex at 32% of elongation, and a flex abrasion resistance of 415 cycles.

The blended yarn was fed into a known false twist texturizing device with a false twist spindle and texturized at a feed-in speed of 147,5 m/min, a contact heater temperature of 190° C and a false twist of 2300 twist per meter. At an output speed of the false twist device, being situated 1% below the input-speed, a thread tension of 25 g upstream the texturizing spindle with sapphire center pin and of 55 g downstream the spindle had been measured. The obtained voluminous, highly elastic filament yarn showed not only a crimped, but also an excellent fiber-like character due to the numerous loose filament ends sticking out having an individual titer of dtex 1,7.

The yarn so obtained did not contain any loops, coils or whorls.

The following textile characteristics have been measured:

| | |
|---|---|
| Tenacity | 26 g/tex |
| elongation | 15% |

-continued

| | |
|---|---|
| initial crimp $c_1$ | 25% |
| residual crimp $c_3$ | 16%. |

EXAMPLE 5 (comparative)

The blended yarn of Example 4, which had been drawn and plyed on the draw-twister were fed into a device corresponding to FIG. 1 of U.S. Pat. No. 2,869,967 instead of the false twist device. The speed of the take-up rolls was 60 m/min, the amount of overfeed between the periphical speed of the feed and the take-up rolls was 30%.

Air was supplied to the nozzle at a pressure of 3 or more kg/cm² gage. The yarns so obtained showed a multiplicity of loops, coils and whorls. Using air of increasing pressure more distinct loops have been observed, however, said yarns exhibited no protruding filament ends. If the pressure of the air was increased above 5 kg/cm² gage the whole yarn was ruptured repeatedly but no filament ends sticking out could be observed.

The values of the textile characteristics have been measured as follows:

| | |
|---|---|
| Air pressure | 3 kg/cm² gage<br>tenacity 11,4 g/tex<br>elongation 12,8% |
| Air pressure | 5 kg/cm² gage<br>tenacity 7,9 g/tex<br>elongation 9,9%<br>initial crimp $c_1$ 1,9%<br>residual crimp $c_3$ 1,4%. |

We claim:

1. A voluminous filament yarn of three-dimensional curled filaments without loops, coils and whorls having a positive value of residual crimp $c_3$, with several loose filament ends sticking out and at least said ends having a flex abrasion resistance of less than about 1500 cycles.

2. The voluminous filament yarn of claim 1, wherein said yarn consists at least partially of filaments of high molecular polyethylene terephthalate having a flex abrasion resistance of less than 1500 cycles.

3. The voluminous filament yarns according to claim 1, wherein said yarn consists at least of two types of filaments having different deniers and wherein at least the filaments having the smallest denier show a flex abrasion resistance of less than about 1500 cycles.

4. The voluminous filament yarn according to claim 1, wherein at least said filament ends sticking out have a flex abrasion resistance of less than about 1000 cycles.

5. The voluminous filament yarn according to claim 1, wherein at least said filament ends sticking out have a flex abrasion resistance of less than about 500 cycles.

* * * * *